US005590765A

United States Patent [19]

London

[11] Patent Number: 5,590,765

[45] Date of Patent: Jan. 7, 1997

[54] HANGER SUPPORT FOR GARMENT BAG COMPRISING A LATCHING DEVICE WITH A FRONT PLATE

[75] Inventor: Wallace London, Baltimore, Md.

[73] Assignee: Clemco Products, Inc., Baltimore, Md.

[21] Appl. No.: 560,501

[22] Filed: Nov. 17, 1995

[51] Int. Cl.[6] ..... A45C 3/00; B65D 85/18

[52] U.S. Cl. ..... 206/289; 206/287; 206/291; 211/124

[58] Field of Search ..... 206/278–292; 211/124; 248/316.1

[56] References Cited

U.S. PATENT DOCUMENTS

| | | | |
|---|---|---|---|
| Re. 31,075 | 11/1982 | London et al. | 206/287 X |
| 2,023,962 | 12/1935 | Levine | 206/289 |
| 2,259,045 | 10/1941 | Powell | 206/292 X |
| 2,303,678 | 12/1942 | Bracken et al. | 206/291 X |
| 2,671,706 | 3/1954 | Greenwood | 206/286 X |
| 3,566,456 | 3/1971 | London | 206/279 |
| 4,252,220 | 2/1981 | London et al. | 206/285 X |
| 4,363,388 | 12/1982 | London et al. | 206/207 X |
| 4,438,844 | 3/1984 | Kesselman et al. | 206/287.1 |
| 4,618,058 | 10/1986 | Gregg et al. | 206/291 |
| 4,753,342 | 6/1988 | Pultchino, Jr. et al. | 206/279 X |
| 4,769,878 | 9/1988 | Liao | 206/291 X |
| 4,798,289 | 1/1989 | Mobley | 206/287 |
| 4,852,845 | 8/1989 | Lener | 206/291 X |
| 4,880,113 | 11/1989 | Mobley | 206/287 |
| 5,048,785 | 9/1991 | Shaw et al. | 206/291 X |
| 5,099,989 | 3/1992 | Goodin et al. | 206/291 X |
| 5,320,228 | 6/1994 | Chen | 206/291 |
| 5,400,900 | 3/1995 | Myers et al. | 206/289 |
| 5,474,162 | 12/1995 | Shyr et al. | 206/289 X |

*Primary Examiner*—Sue A. Weaver
*Attorney, Agent, or Firm*—Irvin A. Lavine; Nath & Associates

[57] ABSTRACT

A hanger support construction for attachment to a garment bag has a pair of clamp jaws pivotally connected adjacent their rear ends, and a latching device for releasably securing the clamp jaws in the closed position, the latching device including a front plate forwardly of the forward ends of the clamp jaws, an actuating lever which is connected by a pivot to one of the clamp jaws, and a retainer which comprises the front plate, a link that engages a surface of one clamp jaw which is remote from the second clamp jaw, a pivot for pivotally connecting the link to the actuating lever, and a connecting structure for connecting the front plate to the link. The connecting structure may include a housing which includes the front plate and plates perpendicular to it which overlie the front end portions of the clamp jaws. The link may comprise a wire loop with transverse pivot portions extending into the actuating lever, and the front plate may form a part of a housing which is joined to the loop by bent ears or resilient ears extending from plates perpendicular to the front plate. In an alternate embodiment, the links are provided by edges of plates perpendicular to the front plate, which are preferably rolled. A pivot pin connects extensions of these plates to the actuating lever.

21 Claims, 2 Drawing Sheets

HANGER SUPPORT FOR GARMENT BAG COMPRISING A LATCHING DEVICE WITH A FRONT PLATE

BACKGROUND OF THE INVENTION

The present invention relates to a hanger support for a garment bag, of the type comprising a pair of pivotally connected clamp jaws having a latching device for releasably securing the clamp jaws in closed position.

Hanger supports having pivoted clamp jaws and a latching device are disclosed in prior patents of Applicant herein including U.S. Pat. Nos. 3,566,456, 4,252,220, and 4,363,388. U.S. Pat. No. 3,566,456 discloses a closed hanger clamp of the above type in which a clasp lever is pivotally connected to one clamp jaw at one end and has a lateral wing at the opposite end having a curved seat for engagement in a notch provided in the other clamp jaw. These patents also disclose a structure in which a wire loop is pivotally connected to an actuating lever which is pivoted to the forward end of one of the clamp jaws, the wire loop passing over the other clamp jaw, so that movement of the actuating lever to the latching position causes the clamp jaws to be drawn towards each other due to the overcenter positioning of the pivot for the latching loop and the pivot connecting the lever to the clamp jaw.

The clamp lever construction of U.S. Pat. No. 3,566,456 would tend to lose reliability over a period of use due to distortion of the clamp lever and the loss of resiliency; the loop and actuating lever construction is more secure and has a longer life, but it is deficient in leaving exposed the somewhat unsightly ends of the clamp jaws. These ends are generally U-shaped since the clamp jaws themselves are of channel shape with resilient material, such as rubber, inserted in the channel of each clamp jaw.

Kastelman et al U.S. Pat. No. 4,438,844 discloses a garment bag construction which includes a closure member 36 which is pivoted and which has first and second walls in angular relationship, so that one wall covers internal operational elements.

Mobley U.S. Pat. No. 4,880,113 provides a locking lever which is pivoted, and which extends in front of the clamp jaws, but which operates by pushing the clamp jaws together, rather than by pulling them together.

Goodin et al U.S. Pat. No. 5,099,899 provides a pivoting cover plate in front of the latching mechanism of a hanger mounting apparatus, this construction also providing closing together and retention of the clamp jaws by compression, rather than tension.

The constructions in the prior art therefore have various problems, which are primarily unreliability of operation over an extended period of repeated usages, and the utilization of a compression structure, and the reliance upon frictionally engaging structures which are subject to wear and thereby subject to diminished reliability.

SUMMARY OF THE INVENTION

The present invention provides a hanger support for a garment bag in which there are provided a pair of preferably channel-shaped clamp jaws having resilient inserts, the clamp jaws being pivotally connected at their rear ends. A latching device is provided which includes an actuating lever pivotally connected to one of the clamp jaws, and a retainer construction which includes a front plate which is forwardly of the forward ends of the clamp jaws, a link which engages the other clamp jaw adjacent the forward end thereof, a pivot connecting the link to the actuating lever, and a structure for connecting the front plate to the link. The front plate is preferably part of a housing which includes the front plate and three plates perpendicular to it.

In a first embodiment, the perpendicular plates are connected to a generally rectangular wire loop which forms a link in tension which engages one clamp jaw and which is pivotally connected to the actuating lever, these perpendicular plates having ears either bent around or resiliently connected to the loop.

In another embodiment, a wire loop is not utilized; the edges of the perpendicular plates of the housing provide the link structure, and preferably are rolled. The side plates of the housing have extensions adjacent the actuating lever, and a pivot pin connects these extensions to the actuating lever.

Among the objects of the present invention are to provide a hanger support which is reliable, durable and maintains its operating characteristics and reliability over a long period of time and usages.

Another object of the present invention is to provide a hanger support of long lasting and reliable construction and which has improved appearance.

Still another object of the present invention is the provision of a reliable and long lasting garment hanger support construction which provides a front plate in position to conceal the ends of clamp jaws used in the construction and thereby provide a more pleasing appearance.

Another object of the present invention is to provide a hanger support in which danger of injury to fingers engaging exposed structural elements of the hanger support when it is in the closed position is obviated.

An additional object of the present invention is to avoid damage to the fabric of the garment bag which is engaged by the clamp structure.

These and other objects and many of the attendant advantages of the present invention will be readily understood from the following specification and claims, and by reference to the appended drawings.

DESCRIPTION OF THE PREFERRED EMBODIMENTS

Figure 1:
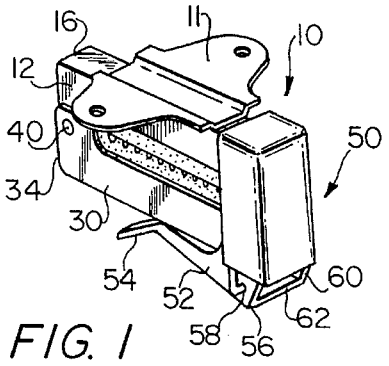
FIG. 1 is a perspective view of a first embodiment of a hanger support in accordance with the present invention.

Referring now to the drawings, wherein like or corresponding reference numerals are used for like or corresponding parts throughout the several views, there is shown in FIG. 1 a garment hanger support 10 comprising a mounting plate 11, which is secured to an upper clamp jaw 12 of known channel-shape construction. A lower clamp jaw 30 of similar construction is pivotally connected to the upper clamp jaw 12 by a pivot pin 40, which passes through the clamp jaws 12 and 30 at the rear ends 16 and 34 thereof.

Figure 2:
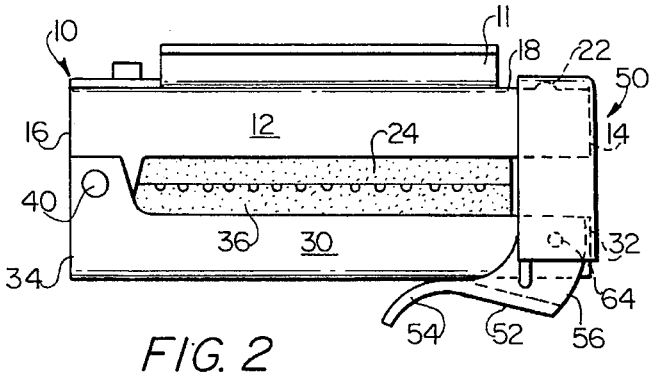
FIG. 2 is an elevational view, with parts removed, of the hanger support of FIG. 1.

As shown in FIG. 2, upper clamp jaw 12 has a forward end 14 and lower clamp jaw 30 has a forward end 32. The upper surface 18 of upper clamp jaw 12 is provided with a detent 22 which is located generally at the forward portion of surface 18 of upper clamp jaw 12. There is also shown in FIG. 2 the pivot pin 40 adjacent the rear end 16 of upper clamp jaw 12 and the rear end 34 of lower clamp jaw 30. The clamp jaws 12 and 30 are preferably of metal, shaped in the form of channels, and there are retained therein, respectively, an upper resilient body 24 and a lower resilient body 36, the latter having a transversely grooved upper surface to receive the hook portions of each of a plurality of garment hangers.

A latching device 50 is provided and comprises an actuating lever 52 which may be seen to have an angularly depending operating end 54 and a forward end 56, provided by a pair of upstanding ears 58 and 60 connected by a transverse plate 62. A transverse pivot pin 64 extends through the ears 58 and 60 and the side flanges of the channel forming the lower jaw 30, to thereby pivotally connect actuating lever 52 to lower clamp jaw 30.

Figure 3:
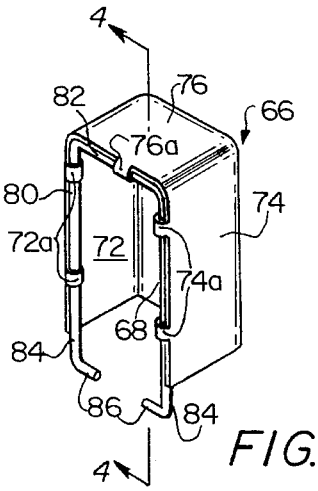
FIG. 3 is a perspective view of a housing and wire loop connected thereto forming a part of the present invention.
Figure 4:
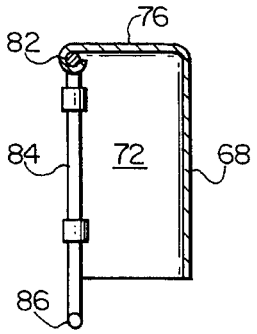
FIG. 4 is a cross-sectional view taken on the line 4—4 of FIG. 3.

The latching device 50 further comprises, as shown in FIGS. 3 and 4, a housing generally designated 66, comprising a front plate 68, a pair of side plates 72 and 74 extending from and transversely of front plate 68, and a top plate 76 which also extends from and transversely of the front plate 68. The front plate 68 is part of a retainer for retaining the clamp jaws 12 and 30 in the closed position, and forming an additional part of the retainer is a link formed by a loop 80, which is preferably of bent wire having a transverse upper portion 82, longitudinal portions 84 and short pivot portions 86. The side plates 72 and 74 are each provided with a pair of ears 72*a* and 74*a*, and the top plate 76 has an ear 76*a*. These several ears 72*a*, 74*a*, and 76*a* are bent around the loop 80 to thereby connect it to the housing. As will be appreciated, the plates 72, 74 and 76 together with their ears provide a connection between the front plate 68 and the loop 80.

As shown FIGS. 1 and 2, when the latching device 50 is in position to clamp the jaws 12 and 30 in the closed position, the side plates 72 and 74 and top plate 76 lie outwardly, beside the sides of the upper clamp jaw 12 and lower clamp jaw 30, and also adjacent the upper surface 18 of upper clamp jaw 12. The detent 22 is forward of the loop 80 to assist in its placement and retention in place in the clamped position of clamp jaws 12 and 30.

Figure 5:
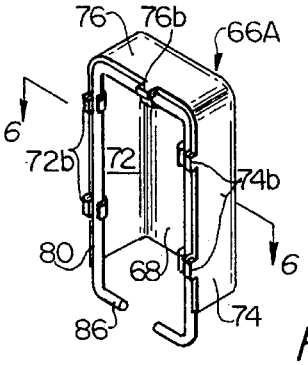
FIG. 5 is a perspective view of an alternate embodiment of a housing and wire loop forming part of the present invention.
Figure 6:
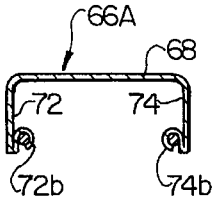
FIG. 6 is a cross-sectional view taken on line 6—6 of FIG. 5.

FIGS. 5 and 6 disclose an alternate construction of the housing and loop, wherein housing 66A is provided with front plate 68, side plates 72 and 74, and top plate 76. The loop 80 is joined to the housing 66 by resilient ears 72*b*, 74*b* and 76*c*, said resilient ears passing around portions of said loop which are proximal to said front plate 68. This enables a rapid assembly of the housing 66A to the loop 80, requiring less manipulation of the parts during manufacture while securely connecting housing 66A to the loop 80.

Figure 7:
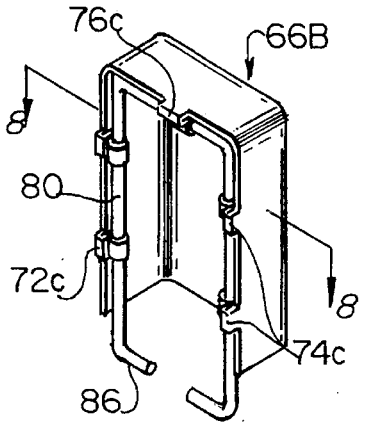
FIG. 7 is a perspective view of still another embodiment of a housing an wire loop forming part of the present invention.
Figure 8:
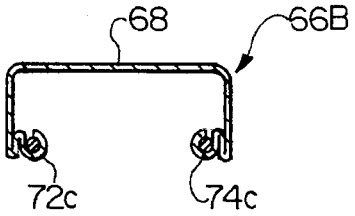
FIG. 8 is a cross-sectional view taken on the lines 8—8 of FIG. 7.

In FIGS. 7 and 8, there is shown an alternate embodiment including housing 66B connected to loop 80 by resilient ears 72*c*, 74*c* and 76*c* which, as shown in FIG. 8, pass around portions of the loop 80 remote from the front plate 68. This construction provides for rapid and secure connection of the housing 66B to the loop 80.

Figure 9:
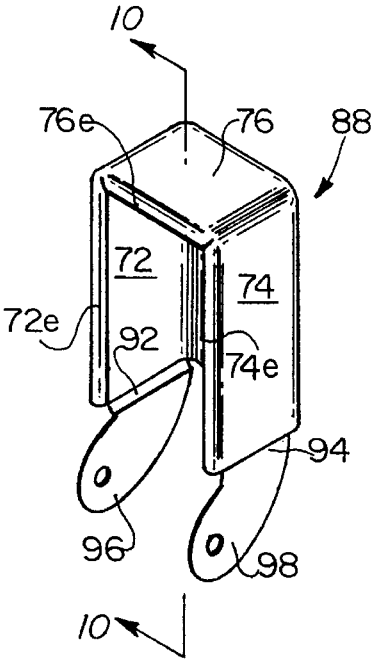
FIG. 9 is a perspective view of a housing forming part of another embodiment of the present invention.
Figure 10:
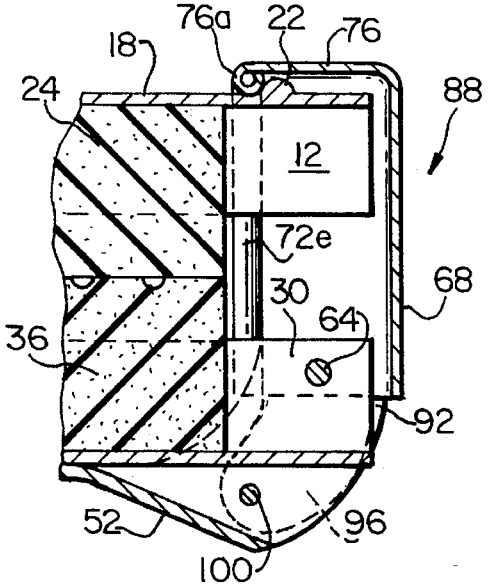
FIG. 10 is a partial cross-sectional view, with parts removed, of the forward portion of an alternate embodiment of a hanger support which includes the housing shown in FIG. 9.

Referring now to FIGS. 9 and 10, there is shown a further alternate construction in accordance with the present invention, wherein a loop 80 is not present. Here, the housing 88 comprises a front plate 68, and perpendicular side plates 72 and 74 and top plate 76. Preferably, side plates 72 and 74 are provided with rolled edges 72*e* and 74*e*, respectively, and top plate 76 is provided with a rolled edge 76*e*. At the lower edges of the side plates 72 and 74, there are provided, respectively, inwardly inclined connector portions 92 and 94, below which are extensions 96 and 98 which are in planes parallel to the side plates 72 and 74, respectively. Thus, the extensions 96 and 98 are closer together than are side plates 72 and 74.

In FIG. 10, there may be seen the housing 88, the forward portions of the upper clamp jaw 12 and lower clamp jaw 30 together with portions of the resilient bodies 24 and 36. The upper surface 18 of the channel forming a part of the upper clamp jaw 12 is provided with a detent 22, rearwardly of which is the rolled edge 76*e* of top plate 76. There may be seen also the pivot pin 64 pivotally connecting the actuating lever 52 to lower channel 30 by passing through holes in ears 58 and 60, and holes in the parallel upstanding flanges of the channel forming lower clamp jaw 30. The inwardly inclined connector portions 92 and 94 are each outwardly of the ears 58 and 60 of actuating lever 52, as are the extensions 96 and 98. A pivot pin 100 pivotally connects the extensions 96 and 98 to actuating lever 52. As shown in FIG. 10, the extension 96 lies behind (outwardly) of the ear 60 of the actuating lever 52. Similarly, extension 96 is outwardly of, parallel to, and closely adjacent to the ear 58.

The housings 50, 66, 66A, 66B, and 88, together with the actuating lever 52, and the pivot structures including the pivot portions 86, pivot pin 88 and pivot pin 64 comprise the latching device 50 in the alternate embodiments of the invention herein disclosed. The latching device also will be seen to comprise a retainer for holding the clamp jaws 12 and 30 in the closed position, the retainer including the front plate 68 of the housing, together with a link formed by the longitudinal portions 84 of the loop 80 or by the edges of the side plates 72 and 74 of the housing 88, and the transverse portion 82 of loop 80 or the front edge of the top plate 76 of housing 88. Further portions of the retainer will be seen to comprise the pivot portions 86 of loop 80 or pivot pin 100 for connection of the link to the actuating lever 52. The retainer structure further comprising the connecting structure for connecting the front plate 68 to the link structure: this includes, for the embodiments of FIGS. 3–8, the side plates 72 and 74 and top plate 76 together with the bent ears 72*a*–76*a* or resilient ears 72*b*–76*b* or resilient ears 72–76*c*. In the embodiment of FIGS. 9 and 10, the connecting structure connecting the front plate 68 comprises the side plates 72, 74 and top plate 76 of the housing 88, inclined connector portion 94, and extension 96.

There have been provided a number of embodiments of an improved hanger support for a garment bag in which there is a latching device which includes a front plate which is forwardly of the forward ends of the clamp jaws, in order to present a more pleasing appearance to the hanger support when it is in the latched or closed position, and which guards against inadvertent injury by a person striking the channels of the upper and lower jaws. The front plate which is forwardly of the forward ends of the clamp jaws avoids abrasion and wearing of the fabric of the garment bag by the forward ends of the clamp jaws. Moreover, the front plate of the present invention provides a convenient site for the designation of the manufacturer or seller of the garment bag of which the herein disclosed hanger support is a part.

In accordance with the construction of the present invention, a proven and superior latching device is provided which includes an actuating lever pivotally connected to one of the clamp jaws, and a link structure for acting on the other jaw, and which is pivotally connecting to the actuating lever to impart a compressive force urging the clamp jaws together. Hence, there is provided by the hanger supports as herein disclosed strong, reliable and long lasting latching devices, which are readily manufactured, which guard against accidental injury to the users of the hanger support, abrasion of the garment bag and which provide an improved, pleasing appearance.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant. Words such as "perpendicular" and "transverse" used herein are to be given both precise and substantially similar meanings.

What is claimed is:

1. A hanger support for a garment bag comprising:

a first and a second clamp jaw each having a rear end and a forward end, a pivot pin pivotally connecting said clamp jaws adjacent the rear ends thereof to permit said clamp jaws to be in a closed, substantially parallel position or in an open, angularly related position, and a latching device for releasably securing said clamp jaws in said closed position or for releasing said clamp jaws for pivotal movement to said open position comprising:

(i) an actuating lever, (ii) a pivot structure pivotally connecting said actuating lever to a first said clamp jaw adjacent the forward end thereof, and (iii) a retainer comprising in the closed and clamped position of said clamp jaws:

(a) a front plate forwardly of the forward end of said clamp jaws, (b) a link engaging a surface of said second clamp jaw remote from said first clamp jaw and being adjacent the forward end of said second clamp jaw, (c) pivot structure for pivotally connecting said link to said actuating lever, and (d) connecting structure for connecting said front plate to said link.

2. The hanger support of claim 1, wherein said link is a wire loop having a transverse portion engaging said surface of said second clamp jaw and longitudinal portions extending therefrom beside said clamp jaws, said pivot structure comprising transverse portions of said loop pivoted to said actuating lever.

3. The hanger support of claim 2, wherein said connecting structure comprises plates extending perpendicularly to said front plate beside the forward end portions of said clamp jaws, and means joining said plates to said wire loop.

4. The hanger support of claim 3, wherein said joining means comprises ears extending from said perpendicular plates and bent around at least said longitudinal portions of said wire loop.

5. The hanger support of claim 4, said connecting structure further comprising a plate parallel to said transverse portion of said wire loop, said joining means further comprising at least one ear extending from said last mentioned plate and bent around said transverse portion of said wire loop.

6. The hanger support of claim 3, wherein said joining means comprises resilient ears extending from said perpendicular plates and engaging at least said longitudinal portions of said wire loop.

7. The hanger support of claim 6, said resilient ears passing around portions of said longitudinal portions of said wire loop.

8. The hanger support of claim 6, said resilient ears passing around portions of said longitudinal portions remote from said front plate.

9. The hanger support of claim 6, said connecting structure further comprising a plate parallel to said transverse portion of said wire loop, said joining means further comprising at least one resilient ear extending from said last mentioned plate and resiliently engaging said transverse portion of said wire loop.

10. The hanger support of claim 1, wherein said connecting structure comprises plates perpendicular to said front plate adjacent the sides of the forward end portions of said clamp jaws and a plate perpendicular to said front plate adjacent said remote surface of said second clamp jaw, and wherein said link comprises edges of said perpendicular plates, said pivot structure comprising extensions from said perpendicular plates adjacent said actuating lever, and a pivot pin pivotally connecting said extensions to said actuating lever.

11. The hanger support of claim 10, said connecting structure further comprising inwardly inclined connector portions between said perpendicular plates and said extensions.

12. The hanger support of claim 1, and said second clamp jaw having a detent extending from a surface thereof adjacent the forward end of said second clamp jaw, said detent being forwardly of said link to assist in the placement and retention in place thereof.

13. A hanger support for a garment bag comprising:

a first and a second clamp jaw each having a rear end and a forward end, a pivot pin pivotally connecting said clamp jaws adjacent the rear ends thereof to permit said clamp jaws to be in a closed, substantially parallel position or in an open, angularly related position, and a latching device for releasably securing said clamp jaws in said closed position or for releasing said clamp jaws for pivotal movement to said open position comprising:

(i) an actuating lever, (ii) a pivot structure pivotally connecting said actuating lever to a first said clamp jaw adjacent the forward end thereof, and (iii) a retainer comprising in the closed and clamped position of said clamp jaws:

(a) a front plate forwardly of the forward end of said clamp jaws, (b) a loop having a transverse portion engaging a surface of said second clamp jaw remote from said first clamp jaw adjacent the forward end of said second clamp jaw, spaced, parallel longitudinal portions and transverse pivot portions, (c) said pivot portions of said loop pivotally connecting said loop to said actuating lever, (d) plates transverse of and extending from said front plate extending to said longitudinal portion of said loop, and (e) means joining said transverse plates to said longitudinal portions of said loop.

14. The hanger support of claim 13, wherein said joining means comprises ears extending from said transverse plates and bent around said longitudinal portions of said wire loop.

15. The hanger support of claim 14, a third transverse plate extending to said transverse portion of said loop, said joining means further comprising at least one ear extending from said last mentioned plate and bent around said transverse portion of said loop.

16. The hanger support of claim 13, wherein said joining means comprises resilient ears extending from said transverse plates and engaging said longitudinal portions of said wire loop.

17. The hanger support of claim 16, said resilient ears passing around portions of said longitudinal portions of said wire loop.

18. The hanger support of claim 16, said resilient ears passing around portions of said longitudinal portions remote from said front plate.

19. A hanger support for a garment bag comprising:

a first and a second clamp jaw each having a rear end and a forward end, a pivot pin pivotally connecting said clamp jaws adjacent the rear ends thereof to permit said clamp jaws to be in a closed, substantially parallel position or in an open, angularly related position, and a latching device for releasably securing said clamp jaws in said closed position or for releasing said clamp jaws for pivotal movement to said open position comprising:

(i) an actuating lever, (ii) a pivot structure pivotally connecting said actuating lever to a first said clamp jaw adjacent the forward end thereof, and (iii) a retainer comprising in the closed and clamped position of said clamp jaws:

(a) a housing having a front plate forwardly of the forward end of said clamp jaws, said housing comprising plates extending from and perpendicular to said front plate adjacent the sides of the forward end portions of said clamp jaws and a plate engaging a surface of said second clamp jaw remote from said first clamp jaw, each of said perpendicular plates extending beside said clamp jaws having an extension, and a pivot structure pivotally connecting said extensions to said actuating lever.

20. The hanger support of claim 19, and further comprising inwardly inclined connector portions connecting said perpendicular plates and said extensions, said extensions being closely adjacent said actuating lever.

21. The hanger support of claim 19, edges of at least one of said perpendicular plates being rolled.

* * * * *